United States Patent [19]

Chattillion

[11] 4,098,059

[45] Jul. 4, 1978

[54] APPARATUS FOR SEALING CONTAINERS

[75] Inventor: Howard G. Chattillion, East Carondelet, Ill.

[73] Assignee: Monsanto Company, St. Louis, Mo.

[21] Appl. No.: 833,793

[22] Filed: Sep. 16, 1977

[51] Int. Cl.[2] ..... B65B 7/28; B67B 1/04; B67B 3/08

[52] U.S. Cl. ..... 53/319; 53/367

[58] Field of Search ..... 53/367, 67, 287, 319, 53/321, 330, 367, 315

[56] References Cited

U.S. PATENT DOCUMENTS

| | | | |
|---|---|---|---|
| 2,983,089 | 5/1961 | Reese et al. | 53/330 X |
| 3,613,332 | 10/1971 | Davis | 53/367 X |
| 3,765,146 | 10/1973 | Ghiretti | 53/67 |
| 3,771,284 | 11/1973 | Boeckmann et al. | 53/315 X |
| 4,018,026 | 4/1977 | Kamisaka et al. | 53/367 X |

*Primary Examiner*—Othell M. Simpson
*Assistant Examiner*—Horace M. Culver
*Attorney, Agent, or Firm*—Richard H. Shear; Donald W. Peterson

[57] ABSTRACT

A continuous, automatic system for sealing containers in which the handle of said container is used to orient the container on a conveyor for easy identification of the container spout.

8 Claims, 4 Drawing Figures

APPARATUS FOR SEALING CONTAINERS

This invention relates to a novel system for sealing containers. It is especially adapted for use with containers having lids with the handle and the pouring spout thereon.

Continuous, automatic capping of containers has proven difficult in the past due to the difficulty in precisely identifying the location of the container spout. Prior art devices have used relatively elaborate systems for locating the spout before capping. For example, U.S. Pat. No. 3,765,146 establishes the center of the container by utilizing three transversal arms spaced precisely 120° apart from each other. Once established, the capper mechanism is lowered and rotated to seek the outside diameter of the container spout. The present invention also utilizes a means for locating and identifying the position of the container spout. However, recognizing the relationship between the position of the handle of such containers relative to their spout, the system uses said relationship to aid in locating and identifying said spout such that consistent capping of the containers may be accomplished at relatively high speeds.

Briefly, the invention contemplates the use of the handle to orient a container so that its spout will be located in a position that may be easily identified by a locator means. Therefore, it is an object of the present invention to provide a system for capping containers.

A second object of the invention is to utilize the handle of said containers to orient the containers on a conveyor.

A further object of the invention is to provide a system and a method for capping containers in a continuous, automatic manner.

These and other objects, advantages and novel features of the invention will become apparent from the following detailed description of the invention when considered in conjunction with the accompanying drawings wherein.

Figure 1:
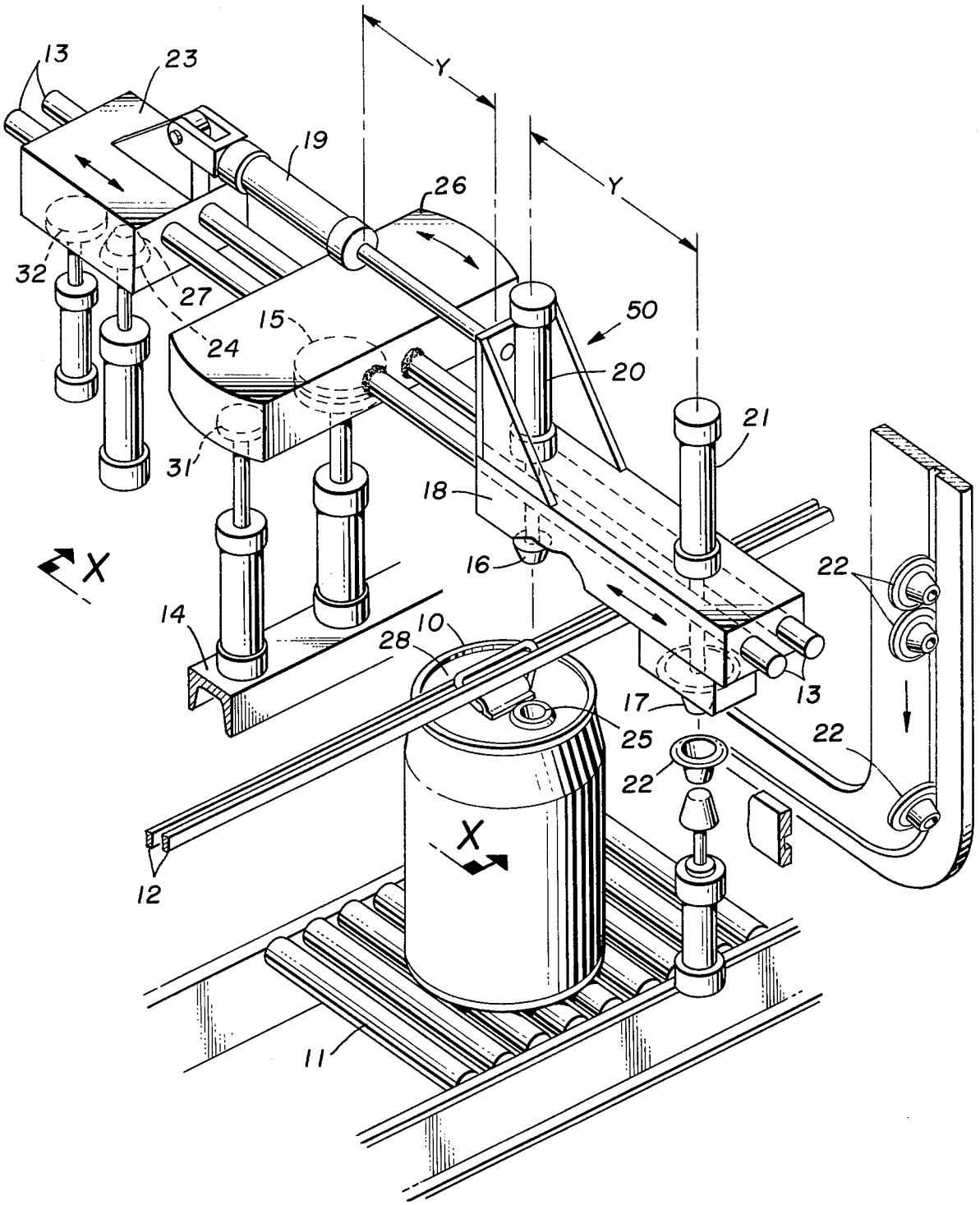
FIG. 1 is a plan view of the novel capping system.

The system 50 as illustrated by the drawings comprises an orientation means consisting of a pair of arms 12 for engagement with the handle of a container 10. Said orientation means is spaced above a conveyor 11 upon which said containers are moved through the capping system. Spaced above said conveyor and orientation means in a position roughly perpendicular to the direction of travel of the containers are a plurality of rails 13. If desired, a single rail may be used, however, two rails are preferred. Said rail or rails are pivotally mounted to a fixed frame 14 at turret 15. Positioned on said rails are blocks 18 and 23. Both blocks 18 and 23 are slidably mounted on said rails so that each is capable of moving longitudinally. Blocks 18 and 23 are connected to one another by longitudinal actuator means 19. The purpose of actuator means 19 will be more fully described below.

Block 18 provides a housing for locator means 16 as well as capper 17. Locator means 16 may be moved vertically by vertical actuator means 20. Capper 17 may be moved vertically by vertical actuator means 21.

Figure 4:
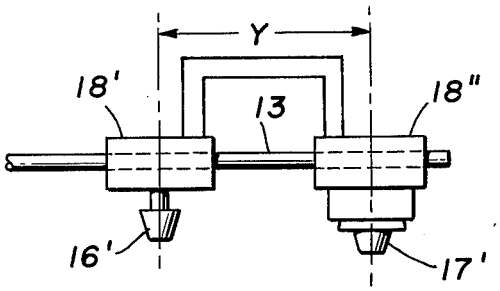
FIG. 4 illustrates a second embodiment of the novel capping system.

FIG. 4 illustrates a second embodiment of the invention wherein said locator means $16^1$ is positioned on a first block $18^1$ and said capper $17^1$ is positioned on a different block $18^{11}$. As will be apparent, blocks $18^1$ and $18^{11}$ are connected to block 23 by a longitudinal actuator means similar to actuator means 19. Additionally, vertical actuator means, not shown, are necessary to vertically move locator means $16^1$ and capper $17^1$.

To aid in initially locating spout 25 of container 10, block 23 is provided with a locking means which may comprise a bore 27 for engagement with a plunger 24. Plunger 24 is mounted to a fixed frame, not shown, so that it cannot freely move except in a vertical manner. By engaging plunger 24 within bore 27 and positioning block 18 at its furthest position with respect to block 23 the locator means should be, approximately, in a position directly above spout 25 of container 10.

Said locator means 16 is spaced a fixed distance Y from capper 17. Longitudinal actuator means 19 is capable of longitudinally sliding block 18 said distance Y. In this manner, capper 17 can be precisely located in the position in which locator means 16 was previously located.

Rails 13 may be housed in block 26 and pivotally mounted to a fixed frame 14 at turret 15 so as to permit movement in a radial manner about the container 10. Such movement permits the locator means to move radially in order to locate spout 25 of container 10.

Figure 2:
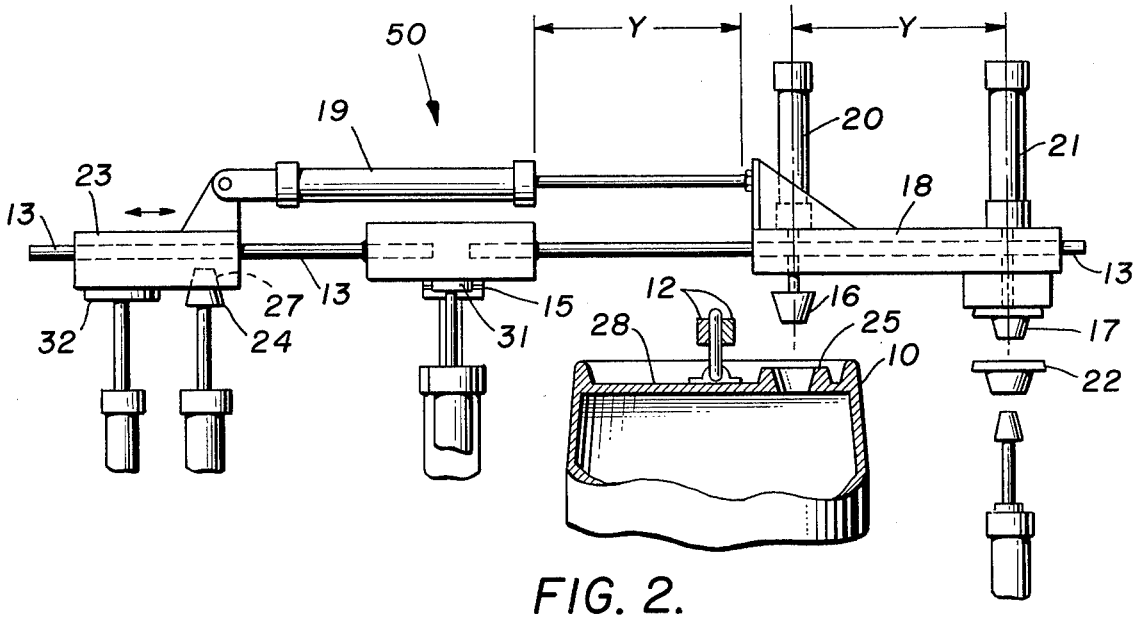
FIG. 2 is a cross-sectional view of the system in the home position taken along the line *x—x* of FIG. 1.
Figure 3:
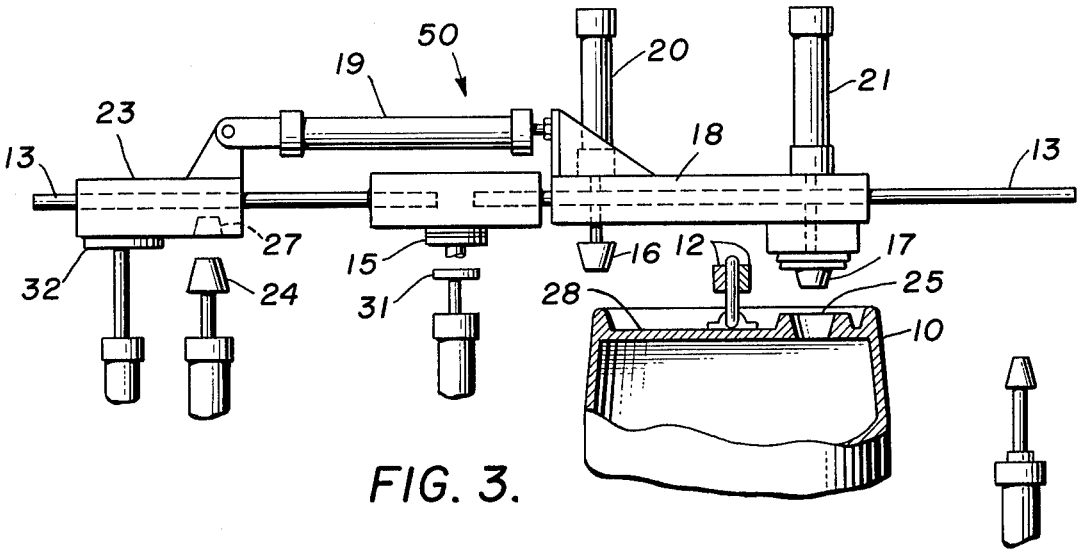
FIG. 3 is a cross-sectional view of the system in the capping position taken along the line *x—x* of FIG. 1.

The invention may be further understood by discussing the manner in which the system operates in conjunction with FIGS. 1, 2 and 3. The handles of containers 10 are placed within a pair of orientation arms 12 such that the spout 25 of each container is in the same approximate position. The containers are then conveyed to the capping system along a conveyor 11. If desired, precise positioning of the containers beneath the capping system can be accomplished by the use of known control means, e.g. mechanical or electrical switches that will indicate the location at the end of a stroke thereby indicating when the containers have reached the precise desired position.

Referring now to FIG. 2, the capping system 50 is in the home position wherein plunger 24 is engaged within bore 27 of block 23. In this position, block 18 is at its furthest position from block 23. This is accomplished by longitudinal actuator 19 being utilized to slide block 18 on rails 13 to said furthermost position. In this position, locator means 16 is located in a position approximately above spout 25. Furthermore, capper 17 is in a correct position for receipt of cap 22.

At this point, plunger 24 is lowered allowing freedom of movement of the capping system. Locator means 16 may then be lowered by vertical actuator means 20. Because orientation arms 12 properly align container 10, the locator means 16 will position itself with respect to spout 25 such that only a slight longitudinal and/or radial movement of said locator means is necessary to precisely identify said spout. Thus, the application of downward pressure on locator means 16 by vertical actuator 20 will provide the force necessary to move blocks 18 and 23 longitudially along rails 13. If necessary, such downward pressure will also provide radial movement of the system about turret 15.

While not necessary for the proper performance of the invention, it may be desired to provide control mechanisms that control the downward movement of locator means 16. It will be appreciated that a proper engagement between locator means 16 and spout 25 requires the locator means to drop into the spout, somewhat below the level of the container lid 28. If improperly aligned, the locator means 16 will be prevented from dropping the required distance by said container lid 28. Said control mechanism can be used to alert the system operator that the container is improperly aligned.

Having identified the spout, brake 32 is engaged to prevent longitudinal movement of block 23. A locking mechanism within longitudinal actuator 19 prevents movement of block 18. The system is then prevented from moving radially by engagement of brake 31. Utilizing these brakes, locator means 16 is prevented from moving longitudinally or radially and, thus, "losing" the position of the spout. At that point, vertical actuator 20 is activated to vertically raise locator means 16.

Longitudinal actuator 19 is now activated to longitudinally move block 18 a fixed distance Y, that distance between locator means 16 and capper 17, such that said capper is now in a position directly above said spout. The system is now in the capping position of FIG. 3. Vertical actuator 21 is then activated to vertically move the capper downward to place and crimp cap 22 on spout 25. Once complete, capper 17 is raised and the system returned to the home position of FIG. 2.

As will be readily appreciated by those skilled in the art, movement may be accomplished by mechanisms known in the art. Actuators used to move the components of the system may be powered pneumatically, hydraulically or electrically. Braking means may be pneumatic, hydraulic or friction. The precise means for braking is not critical. Control mechanisms, where appropriate, may be used.

Although this invention has been described with respect to specific modifications, the details thereof are not to be construed as limitations, for it will be apparent that various equivalents, changes and modifications may be resorted to without departing from the spirit and scope thereof and it is understood that such equivalent embodiments are intended to be included herein.

What is claimed is:

1. A system for sealing containers equipped with a handle which comprises:

a conveyor;

orientation means positioned above said conveyor for engagement with said handle such that said container may be properly oriented on said conveyor;

a rail positioned above said orientation means, said rail being pivotally mounted about a fixed frame for radial movement with respect to said container;

locator means for locating the spout of said container, said locator means being housed within a first block, said first block being slidably mounted upon said rail for longitudinal movement thereon;

a capper housed within said first block and longitudinally spaced a fixed distance from said locator means;

vertical actuator means connected to said locator means for vertical movement of said locator means; and vertical actuator means connected to said capper for vertical movement of said capper.

2. The system of claim 1 which further comprises a second block slidably mounted to said rail, said second block being connected to said first block by a longitudinal actuator capable of moving said first block longitudinally along said rail.

3. The system of claim 2 which further comprises locking means to prevent longitudinal movement of said second block.

4. The system of claim 3 wherein said locking means comprises a bore within said second block and a plunger mounted to a fixed frame for engagement within said bore.

5. The system of claim 2 wherein said second block may be prevented from moving longitudinally by a braking means.

6. The system of claim 1 wherein radial movement of said rail may be prevented by a braking means.

7. A system for sealing containers equipped with a handle which comprises:

a conveyor;

orientation means positioned above and parallel to said conveyor for engagement with said handle such that said container may be properly oriented on said conveyor;

one or more rails positioned above said orientation means, said rails housed within a block which is pivotally mounted to a fixed frame for radial movement with respect to said container;

locator means for locating the spout of said container, said locator means being housed within a first block, said first block being slidably mounted upon said rail for longitudinal movement thereon;

a capper housed within said first block and longitudinally spaced a fixed distance from said locator means;

vertical actuator means connected to said locator means for vertical movement of said locator means;

vertical actuator means connected to said capper for vertical movement of said capper;

a second block slidably mounted to said rails, said second block being connected to said first block by a longitudinal actuator capable of moving said first block said fixed distance longitudinally along said rails;

a bore within said second block;

a plunger mounted to a fixed frame for engagement within said bore;

braking means for preventing longitudinal movement of said second block; and braking means to prevent radial movement of said rails.

8. A system for sealing containers equipped with a handle which comprises:

a conveyor;

orientation means positioned above and parallel to said conveyor for engagement with said handle such that said container may be properly oriented on said conveyor;

one or more rails positioned above said orientation means, said rails housed within a block which is pivotally mounted to a fixed frame for radial movement with respect to said container;

locator means for locating the spout of said container, said locator means being housed within a first block, said first block being slidably mounted upon said rail for longitudinal movement thereon;

a capper housed within a second block and longitudinally spaced a fixed distance from said locator means;

vertical actuator means connected to said locator means for vertical movement of said locator means;

vertical actuator means connected to said capper for vertical movement of said capper;

a third block slidably mounted to said rails, said third block being connected to said first and second blocks by a longitudinal actuator capable of moving said first and second blocks said fixed distance longitudinally along said rails;

a bore within said third block;

a plunger mounted to a fixed frame for engagement within said bore;

braking means for preventing longitudinal movement of said third block; and braking means to prevent radial movement of said rails.

* * * * *